US009045267B2

(12) United States Patent
Schütz

(10) Patent No.: US 9,045,267 B2
(45) Date of Patent: Jun. 2, 2015

(54) SKID PALLETT FOR TRANSPORT AND STORAGE CONTAINERS FOR LIQUIDS

(75) Inventor: Udo Schütz, Selters (DE)

(73) Assignee: PROTECHNA S.A., Fribourg (CH)

( * ) Notice: Subject to any disclaimer, the term of this patent is extended or adjusted under 35 U.S.C. 154(b) by 403 days.

(21) Appl. No.: 13/444,621

(22) Filed: Apr. 11, 2012

(65) Prior Publication Data

US 2012/0279885 A1 Nov. 8, 2012

(30) Foreign Application Priority Data

May 4, 2011 (DE) ..... 10 2011 075 266

(51) Int. Cl.
*B65D 19/00* (2006.01)
*B65D 1/34* (2006.01)
*B65D 77/04* (2006.01)

(52) U.S. Cl.
CPC ..... *B65D 77/0466* (2013.01); *B65D 19/0048* (2013.01); *B65D 2519/00034* (2013.01); *B65D 2519/00069* (2013.01); *B65D 2519/00129* (2013.01); *B65D 2519/00273* (2013.01); *B65D 2519/00288* (2013.01); *B65D 2519/00323* (2013.01); *B65D 2519/00333* (2013.01); *B65D 2519/00407* (2013.01);
(Continued)

(58) Field of Classification Search
CPC ..... B65D 19/004; B65D 19/0012; B65D 77/0466
USPC ..... 206/386, 600; 108/55.1, 56.1, 56.5, 108/57.25, 901, 902, 56.3; 220/9.4, 571
See application file for complete search history.

(56) References Cited

U.S. PATENT DOCUMENTS 4,735,154 A * 4/1988 Hemery ..... 108/56.1
6,109,190 A 8/2000 Hale et al.
6,199,488 B1 * 3/2001 Favaron et al. ..... 108/57.25
(Continued)

FOREIGN PATENT DOCUMENTS

CN 1248917 C 4/2006
CN 101519150 A 9/2009
(Continued)

OTHER PUBLICATIONS

Translation of Japan Patent Office Notice of Reasons for Rejections, Patent Application No. 2012-105253, Jul. 2, 2013, pp. 1-4.
(Continued)

*Primary Examiner* — Luan K Bui
(74) *Attorney, Agent, or Firm* — Quarles & Brady LLP

(57) ABSTRACT

A skid pallet comprising an inner container made of plastic, comprising a lockable filler neck and a discharge nozzle for connecting a removal fitting as well as an outer jacket made of a metal lattice or metal plate. The skid pallet is equipped to be handled by forklifts, a storage and retrieval machine or similar transport equipment and is equipped with a pallet floor, which is supported on support feet of a central skid and two outer skids. The central skid and the outer skids are connected to one another by a skid bridge forming a pallet base, which can be handled independent from the pallet floor, and that, for establishing a non-positive plug-in connection with the pallet base, the pallet floor furthermore encompasses engagement devices, which are assigned to the support feet and which interact with assigned engagement devices of the support feet.

13 Claims, 5 Drawing Sheets

(52) U.S. Cl.
CPC ..... *B65D 2519/00412* (2013.01); *B65D 2519/00437* (2013.01); *B65D 2519/00572* (2013.01)

(56) References Cited

U.S. PATENT DOCUMENTS

| | | | | |
|---|---|---|---|---|
| 6,250,234 | B1 | 6/2001 | Apps | |
| 6,719,164 | B2 | 4/2004 | Maschio | |
| 7,908,980 | B2 * | 3/2011 | Schmidt et al. | 108/57.25 |
| 7,913,850 | B2 | 3/2011 | Schütz | |
| 7,921,784 | B2 * | 4/2011 | Ogburn et al. | 108/57.25 |
| 2003/0024935 | A1 * | 2/2003 | Kind | 220/571 |
| 2003/0106470 | A1 | 6/2003 | Apps et al. | |
| 2004/0149610 | A1 | 8/2004 | Schutz | |
| 2007/0234933 | A1 | 10/2007 | Donnell, Jr. et al. | |
| 2008/0236455 | A1 * | 10/2008 | Naidu | 108/56.1 |
| 2009/0000525 | A1 | 1/2009 | Schmidt et al. | |

FOREIGN PATENT DOCUMENTS

| | | | |
|---|---|---|---|
| DE | 27 33 457 | A1 | 2/1979 |
| DE | 10038464 | A1 | 3/2002 |
| DE | 20316883 | U1 | 3/2004 |
| DE | 60200454 | T2 | 5/2005 |
| DE | 102008009327 | A1 | 8/2009 |
| EP | 1847465 | A2 | 10/2007 |
| EP | 2090520 | A1 | 8/2009 |
| JP | 2002500136 | A | 1/2002 |
| JP | 2005132493 | A | 5/2005 |
| KR | 1020090116962 | A | 11/2009 |
| WO | 9935042 | A1 | 7/1999 |
| WO | 2010003145 | A1 | 1/2010 |

OTHER PUBLICATIONS

Australian Government, IP Australia, Patent Examination Report No. 1., Application No. 2012201696, Nov. 1, 2013, 3 pages.

State Intellectual Property Office of People'S Republic of China, First Office Action, Application No. 201210137971.1, Jan. 6, 2014, 9 pages [English Language Translation].

Korean Intellectual Property Office, Notice of Rejection, Application No. 10-2012-0046821, Dec. 12, 2013, 8 pages.

European Patent Office, European Search Report, Application No. EP 12 16 5444, Sep. 5, 2012.

* cited by examiner

Fig. 2
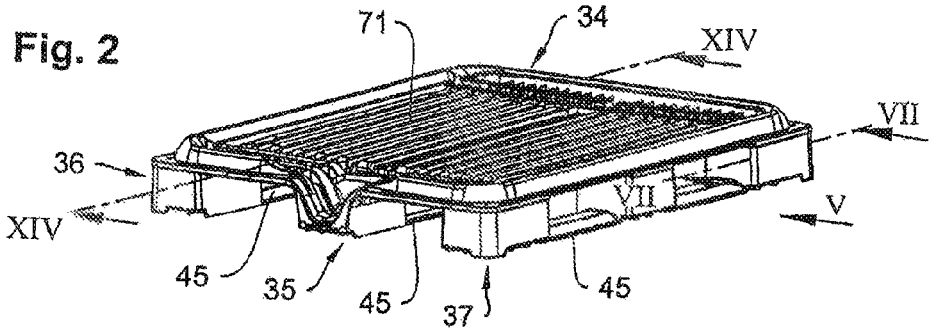
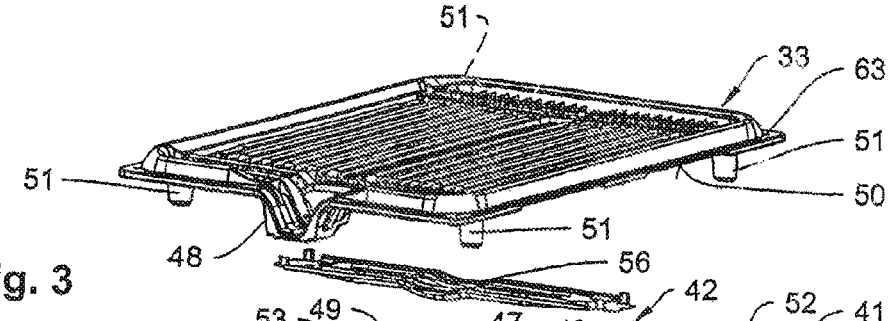
Fig. 3
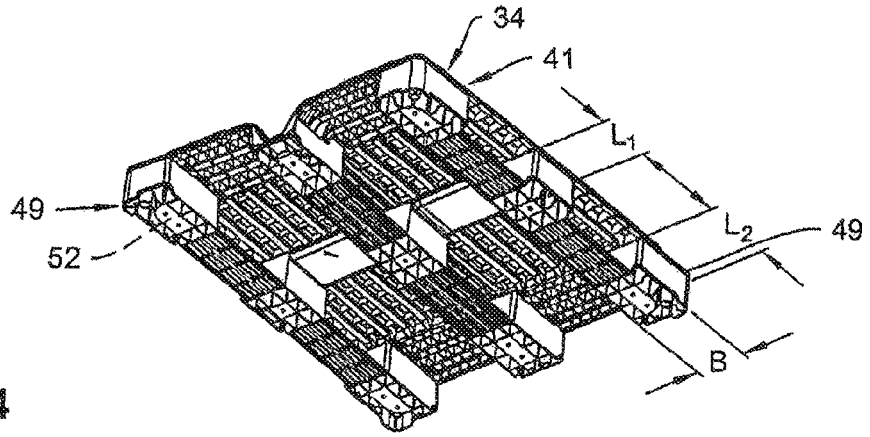
Fig. 4

Fig. 12
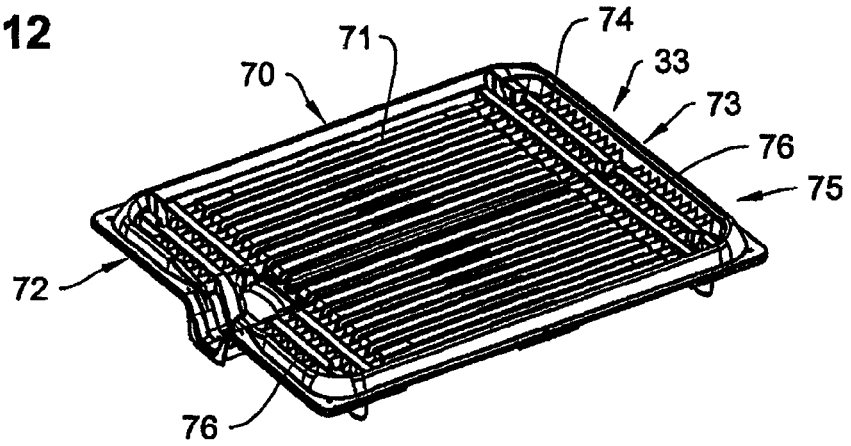
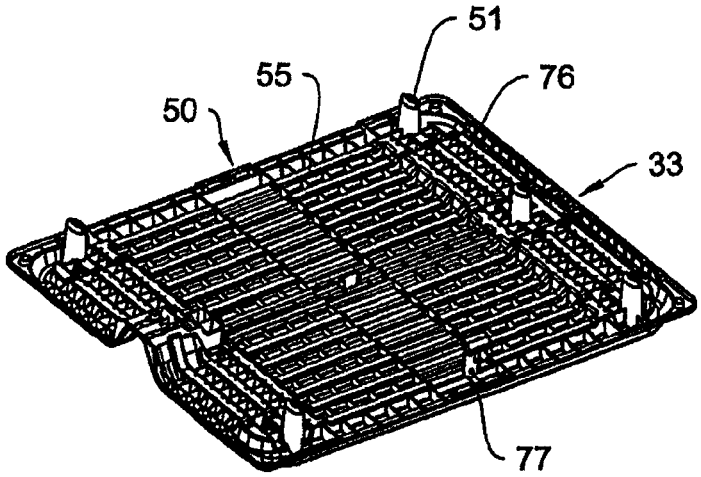
Fig. 13
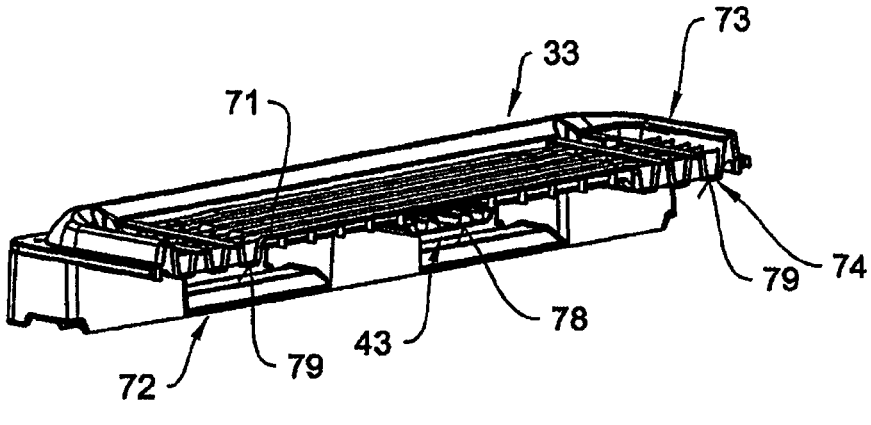
Fig. 14

SKID PALLETT FOR TRANSPORT AND STORAGE CONTAINERS FOR LIQUIDS

CROSS REFERENCE TO RELATED APPLICATION

The present application claims the benefit of German Patent Application No. 10 2011 075 266.8 filed May 4, 2011, which is fully incorporated herein by reference.

STATEMENT REGARDING FEDERALLY SPONSORED RESEARCH OR DEVELOPMENT

Not applicable.

FIELD OF THE INVENTION

The instant invention relates to a skid pallet in particular for transport and storage containers for liquids, comprising an inner container made of plastic, comprising a lockable filler neck and a discharge nozzle for connecting a removal fitting as well as an outer jacket made of a metal lattice or metal plate, wherein the skid pallet is equipped to be handled by means of forklifts, a storage and retrieval machine or similar transport means and is equipped with a pallet floor, which is supported on support feet of a central skid and two outer skids, for supporting the inner container.

BACKGROUND OF THE INVENTION

In the case of the ready-to-use production of transport and storage containers, skid pallets of the afore-mentioned type, which are provided with a pallet floor comprising skids, which are arranged thereon and which are embodied as a central skid and outer skids, are provided in a preassembled form, are provided with the outer jack and are subsequently assembled with the inner container made of plastic. In the jack and are subsequently assembled with the inner container made of plastic. In the case of the known transport and storage containers, connecting processes, which are independent from one another, are carried out for producing the skid pallet as well as for connecting the outer jacket to the finished skid pallet. In particular, the pallet floor is initially connected to the skids on one side so as to then be connected to the outer jacket in a connecting process, which is independent from the first connecting process. As a rule, such connections are carried out as screw connections, so that a screw connection of the pallet skids to the pallet floor is carried out first and a screw connection of the pallet floor to the outer jacket is carried out subsequently. The production of the known ready-to-use transport and storage containers thus turns out to be accordingly extensive.

Finally, a skid pallet of the afore-mentioned type also has the object of providing a manageable platform for storing and for transporting the inner containers, which are made of plastic and which are thus comparatively fragile, by means of suitable forklift devices, so that such skid pallets, in combination with the outer jacket, serve to protect the inner container against damages. The base frames, which are embodied as skid pallets, are to take into account thereby in a special manner the fact that a considerable risk of being damaged exists for the inner containers due to the handling of the transport and storage containers. The pallet-like base frame thus represents a protective shield or protector, which is to absorb in particular impact loads, which can impact the inner container, for example when the transport and storage container hits the floor due to improper handling of the transport and storage container. For this purpose, the base frame must be able to accommodate corresponding applied loads and to still work as handling platform for the liquid container, even after a loading has occurred.

SUMMARY OF THE INVENTION

The instant invention is based on the object of simplifying the ready-to-use production of transport and storage containers, which furthermore encompass base frames for a transport and storage container for liquids that are embodied as skid pallets, which encompass an increased stability, and to thus make it possible to provide for transport and storage containers for liquids, which ensure an increased safety against storage breakdown caused by a lack of stability of the base frame and which are thus particularly suitable for transporting and storing hazardous material.

To solve this object, the skid pallet according to the invention includes a pallet floor, support feet of a central skid and two outer skids supporting the pallet floor. The central skid and the outer skids are connected to one another by means of a skid bridge forming a pallet base, which can be handled independent from the pallet floor. For establishing a non-positive plug-in connection with the pallet base, the pallet floor furthermore encompasses engagement devices, which are assigned to the support feet and which interact with assigned engagement devices of the support feet.

Due to the embodiment of the skid pallet according to the invention, it is possible, for the ready-to-use production of a transport and storage container, to provide a skid pallet, which encompasses the pallet base, which is formed from the central skid and the outer skids, in a mechanical bond with the pallet floor, without requiring the set-up of a connection while handling additional connecting elements for this purpose. Instead, it is possible to establish the mechanically assembled bond between the pallet base and the pallet floor in that the pallet floor is placed onto the pallet base in a defined relative arrangement and a plug-in connection is established between the pallet floor and the pallet base to secure the mechanical bond between the pallet base and the pallet floor. This plug-in connection is carried out by the engagement of the engagement devices of the pallet floor with the corresponding or assigned engagement devices, respectively, of the support feet of the pallet base.

The simple production of a stack arrangement between the pallet floor and the pallet base is thus sufficient to provide for a skid pallet, which can be managed for the further ready-to-use production of the transport and storage container.

In particular, the plug-in connection is sufficient to secure the mechanical bond of the pallet floor to the pallet base during the further assembly, thus for the subsequent arrangement of the outer jacket on the pallet floor. The final, permanent fixation of the pallet floor on the pallet base is then simultaneously carried out with the establishment of the connection between the pallet floor and the outer jacket, for example in that connecting screws, which penetrate through the pallet floor into the support feet of the pallet base, for screw-connecting the outer jacket to the pallet floor. As a whole, a connection is thus created in the case of which the pallet floor is accommodated in a sandwich-like manner between the outer jacket and the support feet, which are connected to one another through the pallet floor to the outer jacket via connecting elements. The plug-in connection also leads to an increase of the inherent stability of the skid pallet.

The particular advantage of the skid pallet according to the invention is thus that a preassembly of the skid pallet is virtually attained by means of the embodiment according to the invention, which secures the bond between the pallet base and the pallet floor at least until a final connection between the pallet base and the pallet floor has been established via the connecting elements, which connect the outer jacket to the support feet of the pallet base.

When the pallet floor encompasses engagement bodies, which are assigned to the support feet of the pallet base and which engage with recesses of the support feet such that a clamping force is created between a peripheral surface of the engagement bodies and a surface of the recess, a space, which is defined by the support feet bodies, can advantageously be used for spatially arranging or embodying, respectively, the plug-in connection between the pallet floor and the pallet base.

It is particularly advantageous when the engagement bodies of the pallet floor encompass a conical body comprising an elliptical cross section, which engages with the recesses of the support feet such that a linear contact area results between the peripheral surface of the engagement body and a contact surface of the recesses, wherein the contact area runs through the intersection point of the long elliptical axis of the elliptical cross section with the contact surface. On the one hand, the conically embodied engagement body of the pallet floor provides for an embodiment of a force fit between the engagement body of the pallet floor and the recess of the support foot such that the holding force, which is required to establish the mechanical bond between the pallet floor and the pallet base, is already created due to gravity, and, if applicable, at best a small repressing is necessary to sufficiently secure the mechanical bond for the subsequent assembly. In addition, the linear embodiment of the contact area between the peripheral surface of the engagement body and the contact surface of the recess provides for the creation of large holding forces. A similarly advantageous effect is also attained—albeit possibly to a lesser extent—when the conical engagement body encompasses a round or rounded cross section. The embodiment of a linear contact area is essential in any case.

In the event that at least one engagement body of the pallet floor is embodied as a centering appendage, which engages with a recess of the pallet base, an accurate relative positioning of the pallet base relative to the pallet floor can be realized in the connection plane between the pallet base and the pallet floor simultaneously with the establishment of the plug-in connection between the pallet floor and the pallet base. In particular, the engagement body, which is used as a centering appendage, can be embodied independent from the engagement bodies, which serve to establish the mechanical bond, thus for the plug-in connection, so that the centering process does not have an impact on the embodiment of the holding forces and can thus also not impact the embodiment of sufficient holding forces.

In the case of a particularly preferred embodiment of the skid pallet, the pallet floor and the pallet base are produced as plastic parts, so that a parallel production of the pallet base and of the pallet floor is possible in a particularly advantageous manner in a simultaneous shaping process, in particular an injection molding process, and that the skid pallet can be produced as intermediate product for the further ready-to-use production of the transport and storage container immediately following the parallel production of the pallet floor and of the pallet base by producing a stack arrangement between the pallet floor and the pallet base. In particular a separate storing of pallet floors and pallet bases is thus no longer necessary. Instead, the combination thereof to form the skid pallet according to the invention takes place immediately after the creation of the pallet floors and the pallet base.

In particular in the case of an embodiment of the pallet floor and of the pallet base from plastic, it appears to be advantageous when the skid bridge of the pallet base is provided with a reinforcement insert for reinforcing the pallet floor. Possibly existing stability deficits of the pallet floor can be compensated with this, without an impairment of the above-described assembly process of the pallet floor and of the pallet base being impaired by producing a stack arrangement. Instead, the reinforcement insert can be inserted as intermediate layer between the pallet base and the pallet floor when establishing the bond.

It is particularly advantageous thereby when the reinforcement insert consist of a floor cross member, which is preferably made of metal and which is arranged on a support surface of the skid bridge, which connects the outer skids to one another and which faces a bottom side of the pallet floor. The insertion of the reinforcement insert during the assembly process can thus take place by simply placing the reinforcement insert onto the skid bridge.

It is particularly advantageous when the floor cross member is positively connected to the skid bridge for the relative positioning and when it is non-positively connected to the pallet floor for stiffening the pallet floor. The establishing of the positive connection thereby takes place simultaneously with the placement of the floor cross member and, on the other hand, it is ensured that the intended stiffening effect on the pallet floor is actually attained via the non-positive connection to the pallet floor.

In the event that the recesses, which are embodied in the support feet of the pallet base and which serve to accommodate the engagement bodies of the pallet floor, are provided with a bottom wall for embodying a contact area of the support feet with a bottom wall, it is possible to reduce the surface pressure, which is exerted onto the ground by the support feet, in particular in the case of an inner container of the transport and storage container, which is filled with liquid.

It would also appear to be particularly advantageous when, in response to the same width as the central feet, the corner feet of the pallet base encompass a larger length than the central feet, so that a further reinforcement of the pallet floor is attained via the increased length of the corner feet.

With reference to the embodiment of the pallet floor, it would also appear to be advantageous when the pallet floor encompasses a central section and a front and rear edge section, wherein longitudinal seams are embodied in a support surface of the pallet floor in the central section and cross seams, which run parallel to the edges of the pallet floor, are embodied in the edge sections, wherein, to form an increased stiffness, the cross sectional height of the cross seams is embodied so as to be larger than the cross sectional height of the longitudinal seams in the central section and a corresponding overhang of the cross seams is embodied opposite to the bottom side of the central section. It is attained here that the bottom sides of the cross seams and of the skid bridge, which face the ground, are arranged in a common plane, so that, in response to the accommodation of the skid pallet by means of a forklift device, the teeth of the forklift device abut against the bottom side of the cross seams in the same manner as against the bottom side of the skid bridge, and the surface pressure, which acts in each case in the contact areas, is reduced advantageously.

This is the case in particular when the overhang is advantageously dimensioned such that it corresponds to the distance of the support surface of the skid bridge from the bottom side of the central section.

When the central skid encompasses a skid base, which connects the support feet of the central skid to one another and the height of which is embodied so as to be smaller than the height of the skid base, which connects the support feet of the outer skids to one another, it is attained that a clear distance, which is still sufficient, is present between the bottom side of the pallet floor and the skid base even in the case of a pallet floor, which is deflected downwards due to the weight load by means of an inner container in the central section, which is filled with liquid, so that the risk of a collision of the lift truck teeth with the skid pallet, is reduced even when the teeth of a forklift device drive under the pallet floor at right angles to the longitudinal direction of the transport and storage container.

BRIEF DESCRIPTION OF THE DRAWINGS

A preferred embodiment of the skid pallet will be defined in more detail below by means of the enclosed drawings.

FIG. 2 shows a perspective illustration of the skid pallet;

FIG. 3 shows an exploded illustration of the skid pallet illustrated in FIG. 2;

FIG. 4 shows a perspective illustration of the skid pallet in bottom view;

FIG. 12 shows a perspective illustration of the pallet floor of the skid pallet in top view;

FIG. 13 shows a perspective illustration of the pallet floor in bottom view;

FIG. 14 shows a sectional illustration of the skid pallet illustrated in FIG. 2 according to the course of sectional line XVI-XVI in FIG. 2.

DETAILED DESCRIPTION OF THE EXAMPLE EMBODIMENTS

Figure 1:
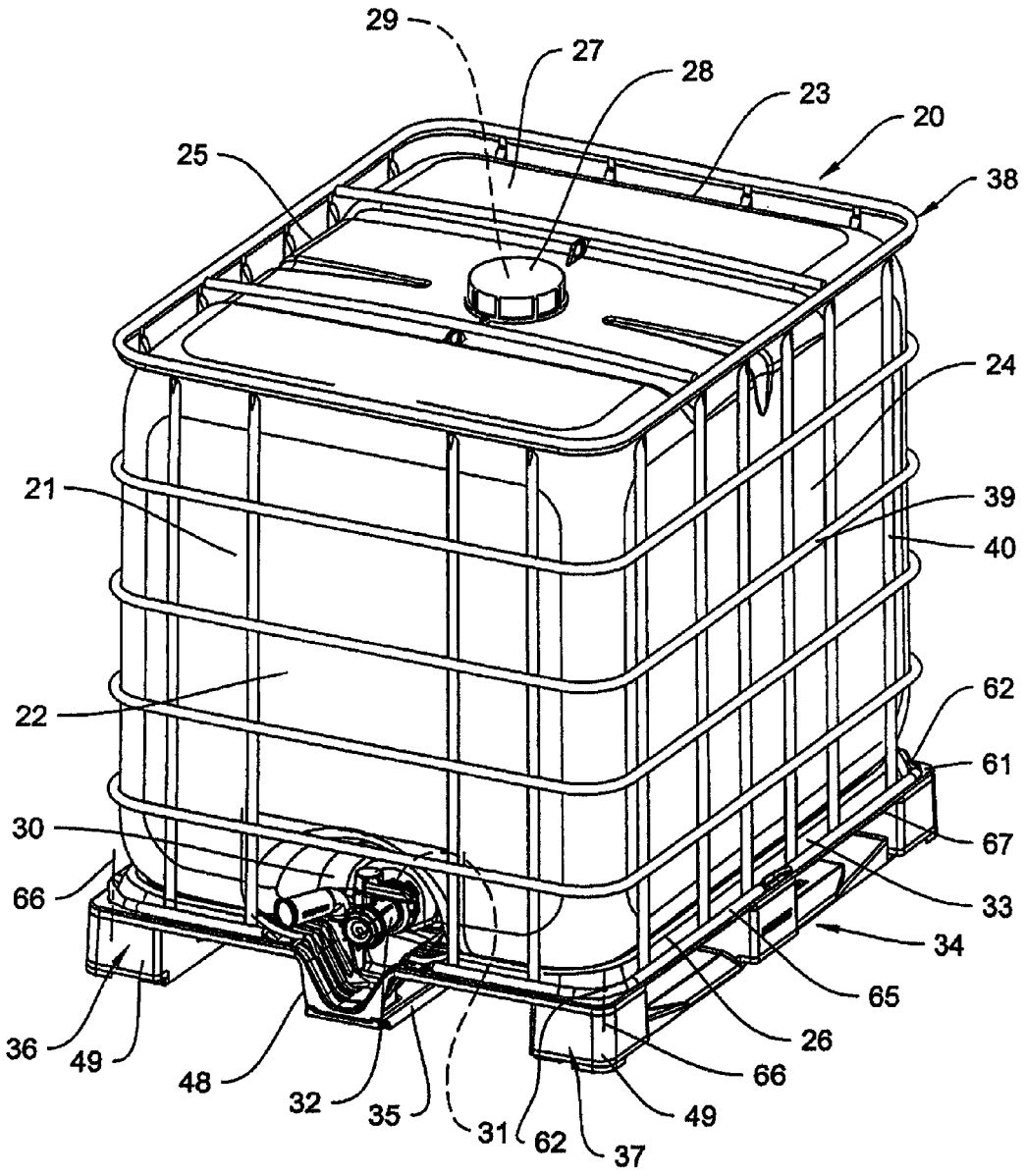
FIG. 1 shows a perspective illustration of a transport and storage container for liquids comprising a base frame, which is embodied as a skid pallet.
Figure 5:
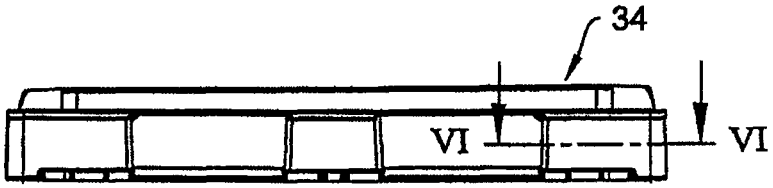
FIG. 5 shows a side view of the skid pallet according to view V in FIG. 2.

FIG. 1 shows a transport and storage container 20, which can be used as a disposable and reusable container for liquids, which encompasses a replaceable cuboid-shaped inner container 21 made of plastic, comprising a front wall 22, a rear wall 23 and two side walls 24, 25, as well as a lower and an upper bottom wall 26, 27. A filler neck 29, which can be locked by means of a lid 28, is integrally molded to the upper bottom wall 27. At an indentation 30 in the lower section of the front wall 22, the front wall 22 encompasses a discharge nozzle 31, which serves to connect a removal fitting 32.

The inner container 21 is arranged with its lower bottom wall 26 on a pallet floor 33 of a base frame, which is embodied as a skid pallet 34. To support the pallet floor 33, the skid pallet 34 encompasses a central skid 35 and two outer skids 36, 37. For protection, the inner container 21, which is arranged on the pallet floor 33, is accommodated in an outer jacket 38, which is embodied herein as a lattice jacket and which encompasses intersecting horizontal and vertical lattice bars 39 and 40. To connect the outer jacket 38 to the skid pallet 34, a lower edge 65 of the outer jacket 38, which is embodied in a frame-like manner from horizontal lattice bars 39, is connected to the central skid 35 and the outer skids 36, 37 by means of connecting elements, which are embodied as screws 66, for example, wherein a peripheral edge 67 of the pallet floor 33 is accommodated in a sandwich-like manner between the central skid 35 and the outer skids 36, 37.

In the case of the illustrated exemplary embodiment, as follows from FIG. 3, which shows the skid pallet 34 illustrated in FIG. 2 in an exploded illustration, the skid pallet 34 consists of three components, namely a pallet base 41, which surrounds the central skid 35 and the two outer skids 36, 37, the pallet floor 33 and a floor cross member 42. For establishing a mechanical bond, the pallet base 41 encompasses, between the central skid 35 and the two outer skids 36, 37, a skid bridge 43, which in each case spans the space between the central skid 35 and the two outer skids 36, 37 and which, in the instant case, connects a central foot 44 of the central skid 35 to the central feet 44 of the two outer skids 36, 37. In addition to the central foot 44, the central skid 35 and the two outer skids 36, 37 encompass outer feet 46, 47 at the axial ends of a skid base 45. In the case of the instant exemplary embodiment, the outer foot 46, which is embodied at the front side of the central skid 35, is embodied such that it can accommodate a floor recess 10, which is embodied adjacent to the discharge nozzle. 31 (FIG. 1) of the inner container 21 in the pallet floor 33. As further follows from a combined view of FIGS. 2 and 3, the outer feet 46, 47 of the two outer skids 36, 37 embody corner feet 49 of the skid pallet 34.

As is shown in FIG. 3, the pallet floor 33, at its bottom side 50, encompasses engagement bodies 51, which are arranged such that they encompass a relative arrangement, which corresponds to recesses 52 in the corner feet 49 and the rear outer foot 47 of the central skid 35, and which can be lowered into the recesses 52 of the corner feet 49 in response to a suitable orientation of the pallet floor 33 relative to the pallet base 41 in a stack arrangement of the pallet floor 33 on the pallet base 41. For stiffening the pallet floor 33, the bottom cross member 42 is placed onto a support surface 53 of the skid bridge 43 prior to the production of the stack arrangement of the pallet floor 33 on the pallet base 41. A defined positioning of the floor cross member 42 on the skid bridge 43 is thereby attained in that a positive connection is established between recesses in the floor cross member 42, which are not illustrated in detail in FIG. 3, and assigned nubs 54, which project out of the support surface 53. The floor cross member 42 is thus positioned on the skid bridge 43 such that, in response to an arrangement of the pallet floor 33 on the pallet base 41 such that a centering appendage 55, which is illustrated in FIG. 13 and which is embodied on the bottom side 50 of the pallet floor 33, engages with an assigned centering accommodation 56 of the floor cross member 42, force transmission tabs 57, which are embodied at the axial ends of the floor cross member 42, engage in a non-positive manner with assigned recesses, which are not illustrated in detail herein, in the bottom side 50 of the pallet floor 33, simultaneously with the lowering the engagement bodies 51 of the pallet floor 33 into the recesses 52 of the pallet base 41.

Figure 6:
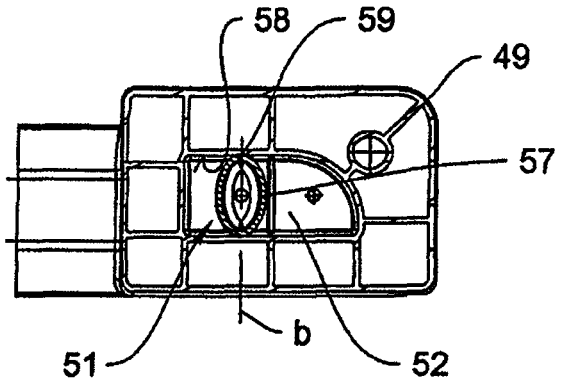
FIG. 6 shows a partial sectional illustration of the skid pallet shown in FIG. 5 according to the course of the intersecting line VI-VI in FIG. 5.
Figure 7:
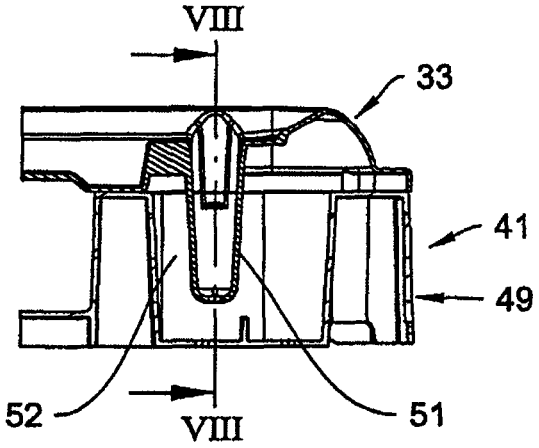
FIG. 7 shows a sectional illustration of a corner foot of the skid pallet according to the course of the intersecting line VII-VII in FIG. 2.
Figure 8:
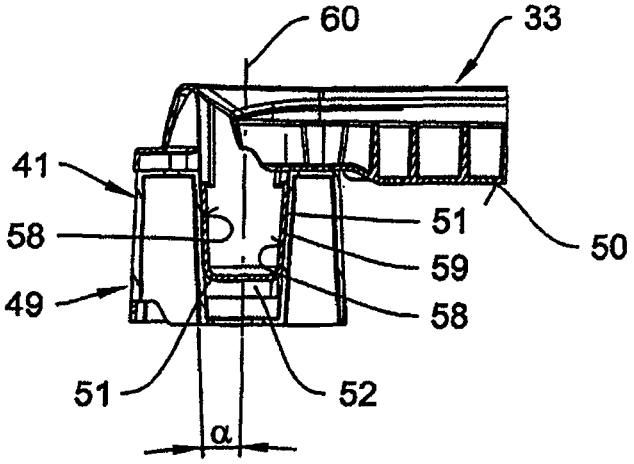
FIG. 8 shows a sectional illustration of the corner foot illustrated in FIG. 7 according to the course of the intersecting line VIII-VIII in FIG. 7.

As becomes clear from a combined view of FIGS. 6, 7 and 8, the engagement bodies 51 encompass the shape of a truncated cone comprising an elliptical cross section 57. The elliptical cross section 57 is thereby oriented in the recess 52 of the corner foot 49 such that the long elliptical axis b forms an intersection point comprising a contact surface 58 of the recess 52, which is substantially flat in the area of the engagement body 51, and a substantially linear contact area 59 is embodied. Due to the engagement bodies 51, which are embodied in a truncated cone-shaped manner, and, as can in particular be seen in FIG. 8, due to the opposite contact walls 58 of the recess 52, which are arranged so as to be substantially wedge-shaped to one another, an increasing clamping force or holding force is generated between the pallet floor 33 and the pallet base 41 with an increasing lowering of the engagement body 51 into the recess 52 after attaching the engagement body 51 to the contact walls 58. In response to suitably choosing the wedge angle α between a vertical axis of the engagement body 51 and the contact walls 58, the dead weight of the pallet floor or, at best a slight repressing of the pallet floor 33, respectively, is already sufficient to establish a mechanically durable bond between the pallet base 41 and the pallet floor 33, which provides for a cohesion of the components of the skid pallet 34 in response to the subsequent assembly steps for producing the transport and storage container 20 illustrated in FIG. 1.

With this, the final mechanical bond between the pallet base 41 and the pallet floor 33 can be established in a common assembly step by establishing the bond between the skid pallet 34 and the outer jacket 38. For this purpose, the connecting elements, which are preferably embodied as screws 66, are then screwed into the corner feet 49 after arranging the outer jacket 38 with its bottom edge 65 on the peripheral edge 67 of the pallet floor 33, which is arranged on the pallet base 41, by means of fastening openings 62, 63, 64, which are arranged so as to be aligned with one another and which are arranged in the bottom edge 65 of the outer jacket 38, the peripheral edge 67 of the pallet floor 33 and the corner feet 49 of the pallet base 41, as becomes clear from a combined view of FIGS. 1 and 3. The final mechanical bond between the pallet floor 33 and the pallet base 41 of the skid pallet 34 thus takes place simultaneously with the connection of the outer jacket 38 to the skid pallet 34.

Figure 10:
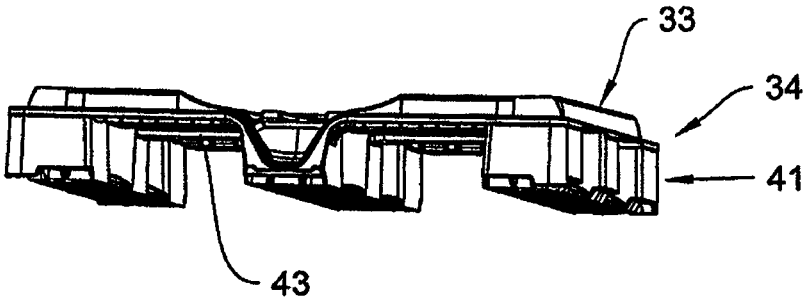
FIG. 10 shows a perspective illustration of the skid pallet in front view.

As becomes clear from a combined view of FIGS. 4 and 10, an accommodation of the floor cross member 42 in the skid pallet 34, which is shielded towards the bottom, results due to the arrangement of the floor cross member 42 on the support surface 53 of the skid bridge 43. FIG. 4 furthermore shows that the recesses 52 in the corner feet 49 are provided with bottom walls 68, which embody a contact area of the corner feet 48.

Figure 9:
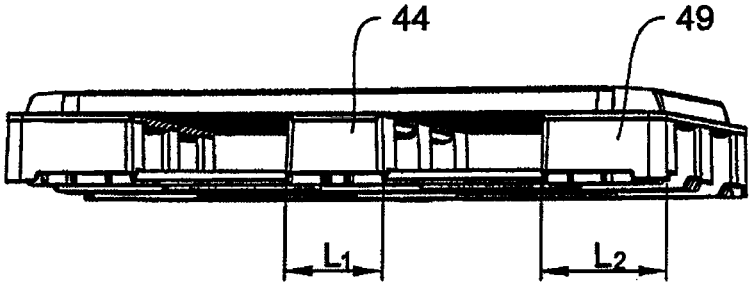
FIG. 9 shows a perspective illustration of the skid pallet in side view.

As follows in particular from a combined view of FIGS. 4 and 9, the central feet 44 and the corner feet 49 are further embodied with a corresponding width B, but the corner feet 49 encompass a larger length L2 compared to the central feet 44, which encompass a length L1.

Figure 11:
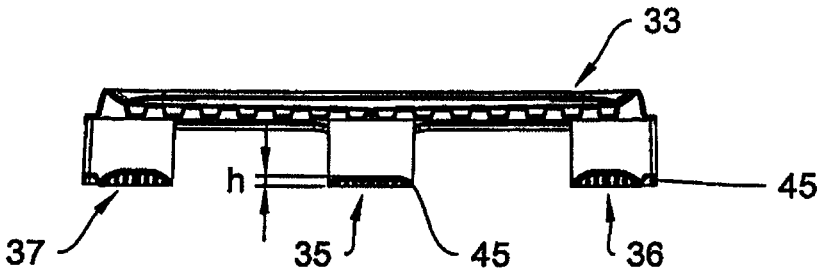
FIG. 11 shows a rear view of the skid pallet.

In addition, in particular a combined view of FIGS. 3 and 11 shows that the skid base 45 of the central skid 35 encompasses a smaller height h than the skid base 45 of the outer skids 36 and 37, so that a clear distance, which is still sufficient, is present between the bottom side 50 of the pallet floor 33 and the skid base 44 in response to applied loads of the pallet floor 33 with an inner container 21, which is filled with liquid, in spite of the maximum deflection of the container floor 33 between the central foot 44 of the central skid 35 and the outer feet 46, 47 of the central skid 35, so as to make it possible for a forklift device to drive under the pallet floor without collisions.

To attain an inherent stiffness, which is as large as possible, while using as little material as possible, the pallet floor 33 encompasses a structure, which encompasses longitudinal seams 71 in a central section 70, and cross seams 74 in edge sections 72, 73, which, in response to an arrangement of an inner container 21 on the pallet floor 33, run parallel to the front wall 22 or the rear wall 23, respectively, of the inner container 21 (FIG. 1), as is illustrated in FIGS. 12 and 13. As is furthermore shown in FIGS. 12 and 13, the cross seams 74 are reinforced against one another on an upper side 75 of the pallet floor 33 as well as on the bottom side 50 of the pallet floor 33 by means of bridges 76. In the area of a central cross beam accommodation 77, which serves for arranging the floor cross member 42, which is illustrated in FIGS. 3 and 14, on the bottom side 50, the longitudinal seams 71 are provided with a return area, which reduces the height of the pallet floor 33.

As is shown in FIG. 14, the height of the cross seams 74 in the edge sections 72, 73 is embodied so as to be larger as compared to the height of the longitudinal seams 71 in the central section 70 such that a bottom side 78 of the skid bridge 43, which accommodates the floor cross member 42 on its support surface 53, is located in a common horizontal plane with bottom sides 79 of the cross seams 74. An accommodating space for the floor cross members 42 is created by embodying an overhang 80 of the bottom sides 79 of the cross seams 74 opposite the bottom sides 81 of the longitudinal seams 71.

The invention claimed is:

1. A skid pallet, in particular for transport and storage containers for liquids, comprising an inner container made of plastic, comprising a lockable filler neck and a discharge nozzle for connecting a removal fitting as well as an outer jacket made of a metal lattice or metal plate, wherein the skid pallet is equipped to be handled by forklifts, a storage and retrieval machine or similar transport equipment, said skid pallet comprising:

a pallet floor for supporting the inner container;

a pallet base including support feet of a central skid and two outer skids, the central skid and the outer skids are connected to one another by a skid bridge, said pallet base being formed independent of the pallet floor, each said support feet including a recess; and engagement bodies extending from said pallet floor, each of said engagement bodies including a conical body received in one of said recesses for establishing a plug-in connection with the pallet base, said conical body having an elliptical cross section, such that a linear contact area results between a peripheral surface of the engagement body and a contact surface of the one of the recesses, wherein the contact surface runs through an intersection point of a long elliptical axis b of the elliptical cross section with the contact surface.

2. The skid pallet according to claim 1, in which the engagement bodies engage with the recesses of the support feet such that a clamping force is created between a peripheral surface of the engagement bodies and a surface of the recesses.

3. The skid pallet according to claim 1, in which at least one engagement body of the pallet floor is embodied as a centering appendage, which engages with one of said recesses of the pallet base.

4. The skid pallet according to claim 1, in which the pallet floor and the pallet base are made of plastic.

5. The skid pallet according claim 4, in which the skid bridge is provided with a reinforcement insert for reinforcing the pallet floor.

6. The skid pallet according to claim 5, in which the reinforcement insert consists of a floor cross member arranged on a support surface of the skid bridge, which connects the outer skids to one another and which faces a bottom side of the pallet floor.

7. The skid pallet according to claim 6, in which the floor cross member is fixed to the skid bridge and reinforces the pallet floor.

8. The skid pallet according to claim 2, in which the recesses, which are embodied in the support feet, are provided with a bottom wall for embodying a contact area of the support feet.

9. The skid pallet according to claim 1, in which the support feet include central feet and corner feet, and the corner feet and central feet have a width B, and the corner feet have a larger length than the central feet.

10. The skid pallet according to claim 1, in which the pallet floor encompasses a central section and a front and rear edge section, wherein longitudinal seams are embodied in a support surface in the central section and cross seams, which run parallel to the edges of the pallet floor, are embodied in the edge sections, wherein, to embody an increased stiffness, the cross sectional height of the cross seams is embodied so as to be larger than the cross sectional height of the longitudinal seams and a corresponding overhang of the cross seams opposite to the bottom side of the central section is embodied.

11. The skid pallet according to claim 10, in which the overhang is dimensioned such that it corresponds to the distance of the support surface of the skid bridge from the bottom side.

12. The skid pallet according to claim 1, in which the central skid encompasses a skid base, which connects the support feet of the central skid to one another and a height of which is smaller than a height of the skid base, which connects the support feet of the outer skids to one another.

13. A transport and storage container for liquids, said container comprising:

an inner container made of plastic and including a lockable filler neck and a discharge nozzle for connecting a removal fitting;

an outer jacket made of a metal lattice or metal plate; and the skid pallet according to claim 1, wherein the inner container and the outer jacket are arranged on the pallet floor of the skid pallet.

* * * * *